US005139045A

United States Patent [19]

Ensign

[11] Patent Number: 5,139,045

[45] Date of Patent: Aug. 18, 1992

[54] SYSTEM FOR DISPENSING A FUEL MIXTURE

[75] Inventor: William H. Ensign, Wilton, Conn.

[73] Assignee: Ensign Petroleum Equipment Co. Inc., South Norwalk, Conn.

[21] Appl. No.: 807,987

[22] Filed: Dec. 16, 1991

[51] Int. Cl.[5] ..... B67D 5/04

[52] U.S. Cl. ..... 137/114; 222/71

[58] Field of Search ..... 137/88, 114, 3; 222/57, 222/71, 26

[56] References Cited

U.S. PATENT DOCUMENTS

| | | | |
|---|---|---|---|
| 3,250,218 | 5/1966 | Sinclair | 137/88 X |
| 3,420,409 | 1/1969 | Petyt | 222/26 |
| 4,978,029 | 12/1990 | Furrow | 222/57 X |

*Primary Examiner*—Alan Cohan

*Attorney, Agent, or Firm*—Woodcock Washburn Kurtz Mackiewicz & Norris

[57] ABSTRACT

A system for mixing a first grade of fuel with a second grade of fuel to create a third, intermediate grade of fuel includes a blend valve and a novel shut-off system for stopping fuel from flowing from the blend valve to a dispensing meter when either the first grade of fuel of the second grade of fuel is not being supplied to the blend valve.

11 Claims, 1 Drawing Sheet

SYSTEM FOR DISPENSING A FUEL MIXTURE

BACKGROUND OF THE INVENTION

1. Field of the Invention

This invention relates to fuel dispensing systems of the type which are commonly deployed at automobile service stations. More specifically, this invention relates to an improved system for mixing a first grade of fuel with a second grade of fuel to create a third, intermediate grade of fuel.

2. Description of the Prior Art

Service stations and other retailers of fuel for automotive vehicles find themselves in an increasingly competitive market. Consumers, when deciding where to purchase such fuel, take selection, pricing and other factors into account.

Most of the service stations which are constructed today have three underground tanks for storing gasoline. The tanks, respectively, are most often used to store low octane, high octane and intermediate grade octane grades of gasoline. As more modern stations are built, consumers are becoming used to selecting from between three grades.

However, many older service stations are provided with only two below ground tanks for storing gasoline. In addition, many of the service stations which have three below ground tanks would prefer to use the third tank for storing another type of fuel, such as diesel fuel or gasohol, rather than to store a third grade of gasoline. It is difficult for such stations to provide consumers with the expected selection of fuels that they have come to expect.

Installing an additional tank for storing fuel is an expensive proposition. In many instances, there are other factors such as zoning regulations and insurance considerations which preclude the installation of an additional tank.

One major retailer of gasoline has successfully implemented a system which blends a high octane grade of gasoline with a low octane grade to present a selection of several different intermediate grades. This system, however, is rather sophisticated and expensive, and would require replacement of much of the pumping and metering equipment to be installed at an existing service station.

It would seem that a simple, inexpensive way to provide an intermediate grade of gasoline would be to mix a regular grade with a premium grade by using a blend valve. However, most state regulatory agencies would not permit such an arrangement, since it might result in regular gasoline being sold at the price of intermediate grade gasoline, in the event that the premium grade gasoline stops being supplied to the blend valve. This could occur when the tank which holds the premium grade gasoline becomes empty, or in the event of a pump malfunction.

It is clear that there has existed a long and unfilled need in the prior art for a simple, inexpensive system for providing an intermediate grade gasoline which can readily be installed in an existing service station, and which will ensure that any fuel dispensed as intermediate is in fact a mixture of higher and lower octane grades.

SUMMARY OF THE INVENTION

Accordingly, it is an object of this invention to provide a simple, inexpensive system for providing an intermediate grade of gasoline in a service station which has a first tank for storing a first, low octane grade of fuel and a second tank for storing a second, high octane grade of fuel.

It is further an object of the invention to provide such a system, which is readily installable at an existing service station with minimal replacement of equipment.

It is a third object of the invention to provide such a system, which ensures that fuel marketed as intermediate grade is in fact an intermediate grade, and is not instead a higher grade or a lower grade.

In order to achieve the above and other objects of the invention, a system for mixing a first grade of fuel with a second grade of fuel to create a third, intermediate grade of fuel according to a first aspect of the invention includes a first tank for storing a first grade of fuel; a second tank for storing a second grade of fuel; a first pump for pumping for the first grade of fuel from the first tank; a second pump for pumping the second grade of fuel from the second tank; a blend valve for blending the first and second grades of fuel from the first and second pumps, respectively, into a third intermediate grade of fuel; a meter for dispensing the third grade of fuel which is received from the blend valve; and a shut-off system for stopping fluid from flowing from the blend valve to the meter when either the first grade of fuel or the second grade of fuel is not being supplied to the blend valve, whereby any fuel dispensed by the meter is assured of being a mixture of the first and second grades of fuel.

According to a second aspect of the invention, a system for mixing a first grade of fuel from a first pump equipped tank and a second grade of fuel from a second pump equipped tank and for supplying the mixed fuel to a dispensing unit includes a blend valve for blending a first and a second grade of fuel, the blend valve having a first port which is adapted to be communicated with an output of a first pump equipped tank, a second port which is adapted to be communicated with an output of a second pump equipped tank, and a third port which is adapted to be communicated with a dispensing unit; structure for sensing a condition at the output of at least one of the first and second pump equipped tanks which is indicative of fuel being pumped from the respective tank; a shut-off valve which is interposed between the blend valve and the dispensing unit; and a controller for controlling the shut-off valve when the sensing structure indicates that insufficient fuel is being pumped, whereby any fuel supplied to the dispensing unit is assured of being a mixture of the first and second grades of fuel.

According to a third aspect of the invention, a system for mixing a first grade of fuel with a second grade of fuel to create a third, intermediate grade of fuel includes a blend valve having a first inlet port, a second inlet port and a third outlet port; a meter in communication with the third outlet port of the blend valve; and a shut-off system for stopping fluid from flowing from the blend valve to the meter when either (1) a first grade of fuel is not being supplied to said first inlet port; or (2) a second grade of fuel is not being supplied to the second inlet port, whereby any fuel dispensed by the meter is assured of being a mixture of the first and second grades of fuel.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT

Figure 1:
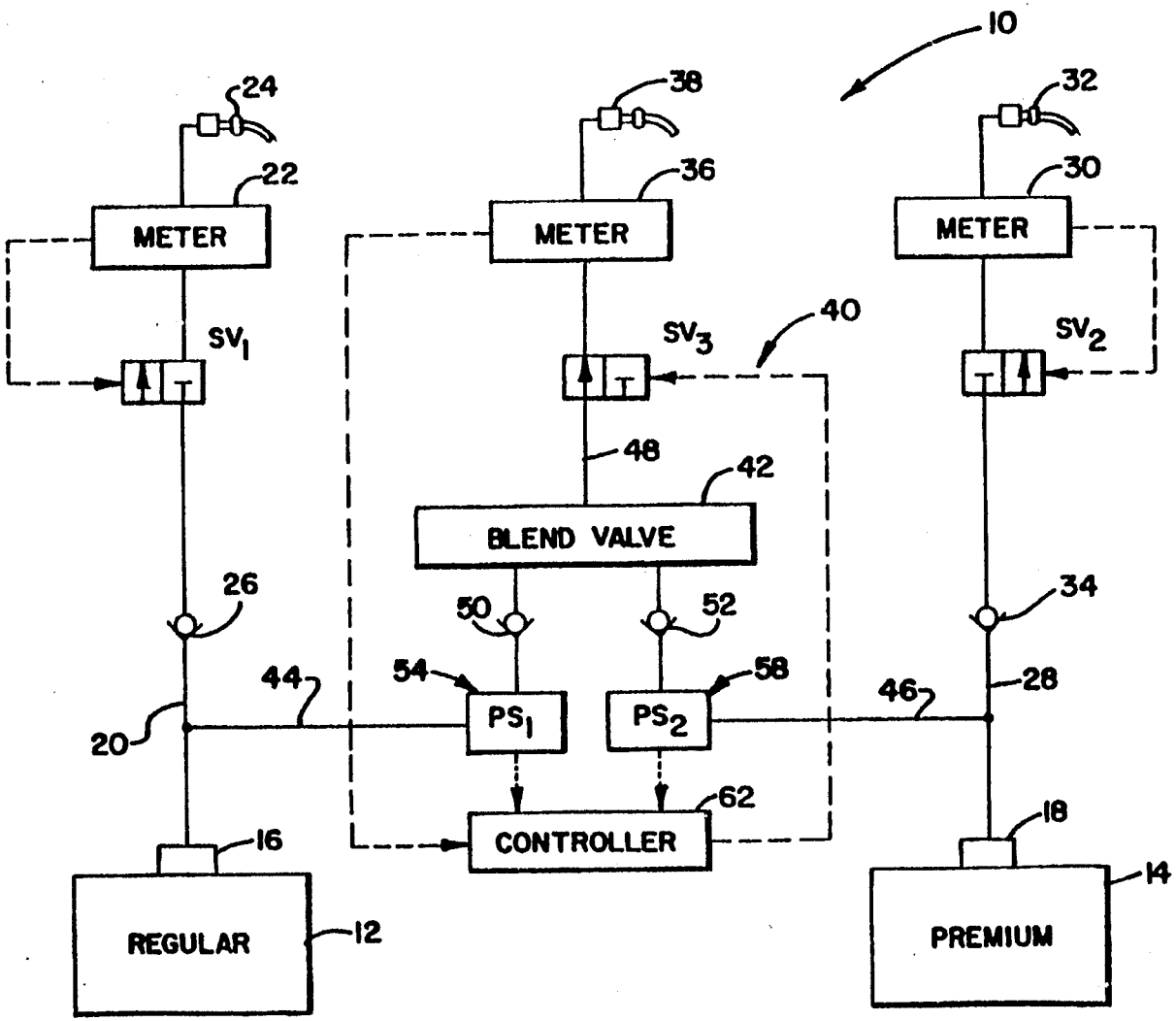
FIG. 1 is a schematic depiction of a system constructed according to a preferred embodiment of the invention.

Referring now to the drawings, wherein like reference numerals designate corresponding structure throughout the views, and referring in particular to FIG. 1, a system 10 for mixing a first grade of fuel with a second grade of fuel to create a third, intermediate grade of fuel, includes a first tank 12 for storing a low octane or regular grade of gasoline, and a second tank 14 for storing a high octane of premium grade of gasoline. Tanks 12, 14 are of the type which are installed underground at an automobile service station. A first pump 16 is connected to first tank 12 for pumping the low octane grade of gasoline to various units at the service station which are used to dispense the regular or low octane grade of gasoline. Similarly, a second pump 18 is provided on second tank 14 for providing high octane or premium gasoline to the units at the service station which are used to dispense that grade. A unit for dispensing low octane or regular gasoline which is pumped from tank 12 by pump 16 includes a first fuel line 20, and a first meter 22 which includes a first nozzle 24. First fuel line 20 communicates first meter 22 with first pump 16 so as to permit fuel to be pumped from first pump 16 to first meter 22. A check valve 26 is provided in first fuel line 20, which allows gasoline to flow from pump 16 to meter 22, but not in the opposite direction. A solenoid actuated valve $SV_1$ is interposed in first fuel line 20 between check valve 26 and first meter 22. Solenoid valve $SV_1$ is electrically controlled by first meter 22 so as to be open when a lever on first meter 22 is positioned in an on position, and to be closed when the lever is positioned in an off position. Conventionally, the lever is positioned so that it cannot be moved to the on position until first nozzle 24 has been removed from the meter. As is conventional, a hand operated valve is provided on first nozzle 24 to control the flow of gasoline from the first nozzle 24 into the fuel tank of a vehicle.

A unit for dispensing premium or high octane fuel from second tank 14 which is pumped by second pump 18 includes a second fuel line 28, and a second meter 30 which includes a second nozzle 32. A check valve 34 is provided between second pump 18 and second meter 30. A second solenoid actuated valve $SV_2$ is interposed between check valve 34 and second meter 30. The operation of the high octane fuel dispensing units is identical to that described above with reference to the low octane fuel dispensing units.

System 10 further includes a third meter 36 for dispensing an intermediate grade of fuel which is a mixture of the low octane fuel provided in first tank 12 and the high octane fuel provided in second tank 14. Third meter 36, which includes a third nozzle 38, is provided with a novel shut-off system 40, which insures that gasoline which is not a true mixture of the high octane and low octane grades is not pumped through third meter 36. According to the system 40, a blend valve 42 has a first port which is communicated with an outlet of first pump 16 by a third fuel line 44. A second inlet port of blend valve 42 is communicated with an outlet of second pump 18 by a fourth fuel line 46. A third, outlet port of blend valve 42 is communicated with third meter 36 via a fifth fuel line 48, as is shown in FIG. 1. Blend valve 42 is thus connected to mix a low octane stream of gasoline which is provided through third line 44 with a high octane grade of gasoline which is provided through fourth fuel line 46 into a mixed, intermediate grade of gasoline which exits through fifth fuel line 48 so as to be provided to third meter 36. A first check valve 50 is provided in third fuel line 44 for allowing gasoline to flow from first pump 16 to blend valve 42, but not in the opposite direction. Similarly, a second check valve 52 is provided in fourth fuel line 46 for allowing gasoline to flow from second pump 18 to blend valve 42, but not in the opposite direction.

A first element 54 is provided in third fuel line 44 between first pump 16 and first check valve 50 for sensing whether fuel is in fact flowing through third fuel line 44. In the preferred embodiment, first flow sensing element 54 is a first pressure sensor $PS_1$. Similarly, a second flow sensing element 58 is interposed in fourth fuel line 46 between second pump 18 and second check valve 52. In the preferred embodiment, second flow sensing element 58 is a second pressure sensor $PS_2$. Alternatively, first and second flow sensing elements 54, 58 could be a different type of sensor for detecting flow, such as a volumetric type flow monitor. In addition, a filtering and a safety shut-off valve (not shown) are preferably located in lines 44, 46 between the respective pressure sensors $PS_1$, $PS_2$ and first and second fuel lines 20, 28. A solenoid actuated shut-off valve $SV_3$ is interposed in fifth fuel line 48, between the output port of blend valve 42 and third meter 36. A controller 62 for controlling the position of valve $SV_3$ is schematically depicted in FIG. 1. Controller 62 received input from third meter 36, from first pressure sensor $PS_1$, and from second pressure sensor $PS_2$. Controller 62 is preferably constructed of electromechanical type relay circuits, although it is contemplated that controller 62 could alternatively be of solid state design. The details of controller 62 will become apparent from the following description of its function. Preferably, the electrical connections between controller 62 and first pressure sensor $PS_1$, second pressure sensor $PS_2$, and third meter 36 are of a low voltage, low current type which would be intrinsically safe for operation in an environment which includes combustible products.

In operation, when third nozzle 38 is in its stored position within third meter 36 and an on/off lever on third meter 36 is in its off position, this information is communicated to controller 62, which positions shut-off valve $SV_3$ in its closed position, regardless of inputs which are provided to controller 62 from first pressure sensor $PS_1$ and second pressure sensor $PS_2$.

When an attendant or motor vehicle operator lifts third nozzle 38 from third meter 36 and flips the control lever to its on position, this information is communicated to controller 62 from third meter 36. Once such an indication is received by controller 62, controller 62 moves shut-off valve $SV_3$ to its open position, thereby communicating third meter 36 with the output port of one valve 42. If both first pump 16 and second pump 18 are operating, this will allow low octane fuel to be pumped from first tank 12 by first pump 16 through third fuel line 44 into one valve 42, while high octane fuel is being simultaneously pumped from second tank 14 by second pump 18 through fourth fuel line 46 into the second inlet port of blend valve 42. The high octane fuel is mixed with the low octane fuel within blend valve 42, creating an intermediate octane blend of fuel which is provided to third meter 36 through fifth fuel line 48, which is communicated with the outlet port of one valve 42.

If first tank 12 becomes empty, if first pump 16 becomes nonoperational, if the filtering device becomes clogged or the safety shut-off valve is tripped, pressure in third fuel line 44 will drop, and low octane fuel ceases to flow through third fuel line 44. This drop in pressure will be detected by first pressure sensor $PS_1$ which will communicate the information to controller 62. Controller 62 will respond to moving shut-off valve $SV_3$ to its closed position, thereby preventing the supply of pure high octane fuel to third meter 36. Similarly, if second tank 14 becomes empty, if second pump becomes nonoperational, if the filtering device becomes clogged or the safety shut-off valve is tripped, high octane will cease to flow and pressure will drop in fourth fuel line 46. This will be detected by second pressure $PS_2$, and reported to controller 62, which will move shut-off valve $SV_3$ to its closed position. In the intermediate time before shut-off valve $SV_3$ is closed, the respective first and second check valve 50, 52 will prevent high octane fuel from entering third fuel line 44 or low octane fuel from entering fourth fuel line 46, respectively.

Alternatively, instead of sensing flow through third fuel line 44 and fourth fuel line 46, with the flow sensing elements 54, 58, other inputs to controller 62 could be used. For example, the current two pumps 16, 18 could be monitored to ensure that the pumping process is operational. Electronic fuel sensors could alternatively be provided in first tank 12 and second tank 14 to advise controller 62 electronically before fuel is exhausted from one of the tanks 12, 14.

For purposes of state regulation, it is only necessary that shut-off system 40 be operational when the premium grade of fuel from second tank 14 is not being supplied to the blend valve 42. Most regulatory agencies are not concerned if premium grade fuel is sold at intermediate prices; they are if regular grade fuel is sold at intermediate grade prices. Thus, shut-off system 40 could alternatively be constructed without first flow sensing element 54. However, it is to the service stations' benefit to prevent premium fuel from be sold at intermediate prices, so it is anticipated that a shut-off system 40 including first flow sensing element will be in greater demand.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed:

1. A system for mixing a first grade of fuel with a second grade of fuel to create a third, intermediate grade of fuel, comprising:

a first tank for storing a first grade of fuel;

a second tank for storing a second grade of fuel;

a first pump for pumping the first grade of fuel from said first tank;

a second pump for pumping the second grade of fuel from said second tank;

a blend valve for blending the first and second grades of fuel from said first and second pumps, respectively, into a third, intermediate grade of fuel;

a meter for dispensing the third grade of fuel which is received from said blend valve; and a shut-off system comprising a valve interposed between said blend valve and said meter for stopping fluid from flowing from said blend valve to said meter when either the first grade of fuel or the second grade of fuel is not being supplied to said blend valve, whereby any fuel dispensed by said meter is assured of being a mixture of the first and second grades of fuel.

2. A system according to claim 1, wherein said shut-off valve is solenoid-actuated.

3. A system according to claim 1, wherein said shut-off system comprises at least one pressure sensor positioned between one of said pumps and said blend valve.

4. A system according to claim 3, wherein said shut-off system comprises a first pressure sensor which is positioned between said first pump and said blend valve and a second pressure sensor positioned between said second pump and said blend valve.

5. A system according to claim 1, wherein said shut-off system comprises means for sensing a condition at the output of at least one of said first and second pumps which is indicative of fuel being pumped through the location of said sensing means.

6. A system according to claim 5, wherein said sensing means comprises a pressure sensor.

7. A system according to claim 1, further comprising a first check valve positioned between said first pump and said blend valve and a second check valve positioned between said second pump and said blend valve, said first and second check valves being oriented to prevent fuel from flowing from said blend valve toward the respective pumps.

8. A system according to claim 1, wherein said shut-off system comprises means for sensing a condition at the output of at least one of said first and second pumps which is indicative of fuel being pumped through the location of said sensing means; and a controller for closing said shut-off valve when said sensing means indicates that insufficient fuel is being pumped

9. A system according to claim 8, wherein said sensing means comprises a pressure sensor.

10. A system for mixing a first grade of fuel from a first pump-equipped tank and a second grade of fuel from a second pump-equipped tank and for supplying the mixed fuel to a dispensing unit, comprising:

a blend valve for blending a first and a second grade of fuel, said blend valve having a first port which is adapted to be communicated with an output of a first pump-equipped tank; a second port which is adapted to be communicated with an output of a second pump-equipped tank, and a third port which is adapted to be communicated with a dispensing unit;

means for sensing a condition at the output of at least one of the first and second pump-equipped tanks which is indicative of fuel being pumped from the respective tank;

a shut-off valve which is interposed between said blend valve and the dispensing unit; and a controller for closing said shut-off valve when said sensing means indicates that insufficient fuel is being pumped, whereby any fuel supplied to the dispensing unit is assured of being a mixture of the first and second grades of fuel.

11. A system according to claim 10, wherein said sensing means comprises a pressure sensor.

* * * * *